United States Patent [19]

Lenson et al.

[11] Patent Number: 4,807,546

[45] Date of Patent: Feb. 28, 1989

[54] SEQUIN APPLICATION APPARATUS FOR SHUTTLE EMBROIDERY MACHINE

[75] Inventors: Harry Lenson, Cliffside Park; Lester L. Moise, Leonia, both of N.J.

[73] Assignee: Sequins of Distinction, Inc., North Bergen, N.J.

[21] Appl. No.: 128,987

[22] Filed: Dec. 4, 1987

[51] Int. Cl.[4] ..... D05B 3/04; D05B 7/02

[52] U.S. Cl. ..... 112/88; 112/104; 112/113; 112/222; 112/265.1

[58] Field of Search ..... 112/222, 113, 104, 322, 112/88, 265, 285; 156/93

[56] References Cited

U.S. PATENT DOCUMENTS

| | | | |
|---|---|---|---|
| 1,550,778 | 8/1925 | Bretschneider | 112/88 |
| 3,390,650 | 7/1968 | Ochsner | 112/88 |
| 4,273,279 | 6/1981 | Kunreuther | 112/104 |
| 4,287,842 | 9/1981 | Breck, Jr. | 112/104 X |
| 4,623,411 | 11/1986 | Pollak et al. | 112/104 X |

*Primary Examiner*—Andrew M. Falik

*Attorney, Agent, or Firm*—Darby & Darby

[57] ABSTRACT

An improved shuttle embroidery machine having an attachment, corresponding to each needle, for the selective application of sequin-like decoration onto a cloth where a sequin strip is indexed by a rotary coin-feed wheel through a feed member for severance by a cylindrical sleeve of the needle at appropriate times.

21 Claims, 3 Drawing Sheets

FIG. 3
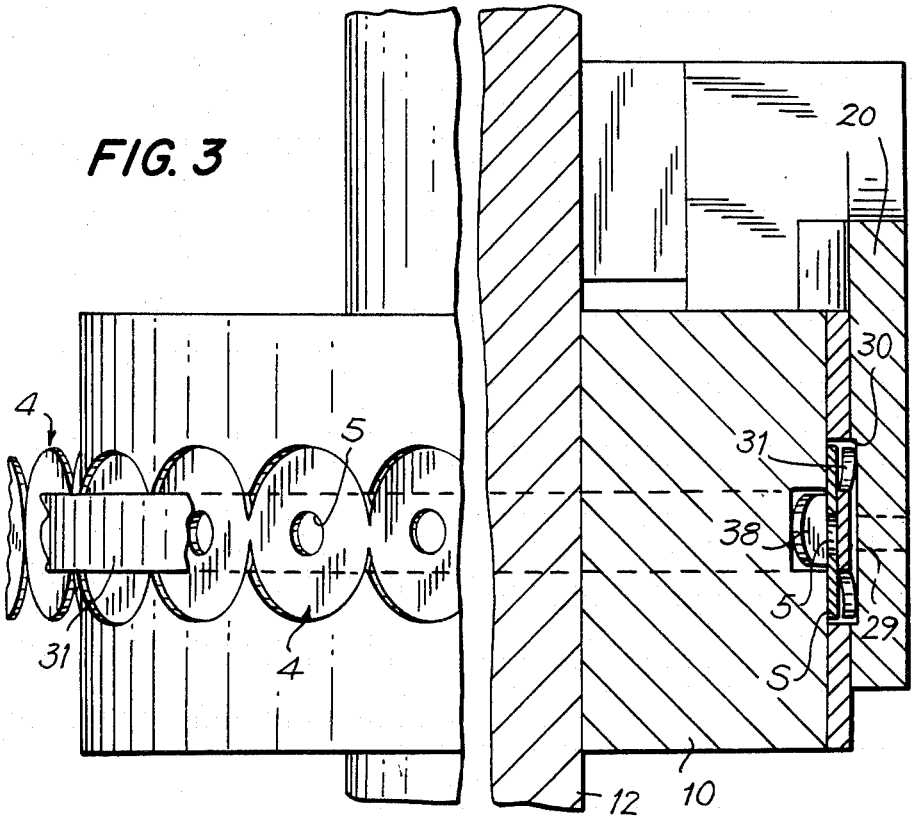
FIG. 4
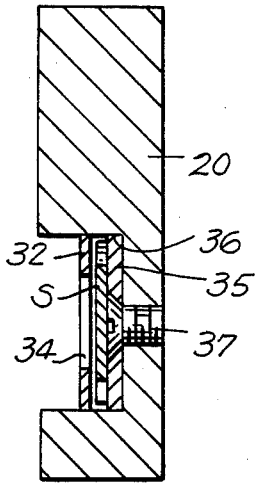
FIG. 5
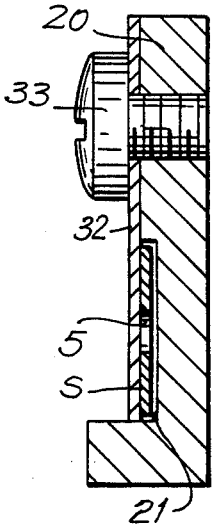
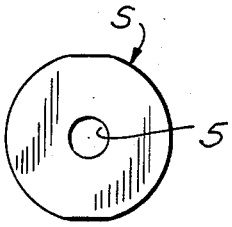
FIG. 6
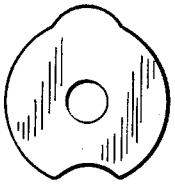
FIG. 7

SEQUIN APPLICATION APPARATUS FOR SHUTTLE EMBROIDERY MACHINE

TECHNICAL FIELD

The present invention relates to an apparatus for selectively applying sequin-like decoration to material during an embroidery operation.

BACKGROUND OF THE INVENTION

The well known shuttle embroidery machine includes a common embroidery frame upon which is mounted four tubes or goods rollers arranged in two sets, one pair over the other. Each of the pairs includes a supply tube upon which there is wound a supply of material or cloth to be embroidered and a rewind tube upon which the embroidered material is wound, the material being stretched between the tube during the embroidering operation. The embroidery frame is shiftable both vertically and horizontally such that the material may be displaced in a complex path determined by the automatic control for the machine. Tke embroidery mechanisms are arranged at relatively stationary locations in relation to the respective pairs and each includes a needle rail at the needle side of the material having a series of needles fixed at spaced locations along the length thereof each of which is fed from a supply of needle thread. A shuttle box rail is provided at the shuttle side of the material which carries a series of longitudinally spaced shuttle boxes corresponding to the needles. The shuttle boxes contain shuttles having bobbins therein providing the supply of shuttle thread for the respective needle threads. Further, at the needle side of the material there is provided a borer point rail which is provided at spaced locations along its length with a number of borer points which, at prescribed intervals during the machine operation, are effective to cut holes in the cloth. Mechanisms are provided for driving the needle rail through a stitch-forming stroke such that the needle threads are passed through the material and form loops through which the respective shuttles are passed causing the shuttle thread to loop through the needle threads, as is generally understood. For certain patterns the borer point rail is operated during the machine cycle to cut the material, and in such instances the holes so cut are bound by the action of the cooperating needles and shuttles.

The needle thread is fed to the respective needles over a yarn tensioning and controlling system which includes, in succession from the supply of the needle thread, a short stroke thread carrier and a long stroke thread carrier. The short and long stroke thread carriers are effective as the needles move through the forward or stitch-forming strokes to initially deliver the needle threads substantially free of tension, to then form a loop through which the shuttle pass as the needles being to retract, and finally to pull back on the needle thread to complete the stitches.

It is generally known to coordinate the various actuating and controlling mechanisms of the shuttle embroidery machine from a common automat. The automat is generally characterized as including a continuous roll of paper or similar material, known as a punching or control tape, which is punched at longitudinal spaced locations and in a number of side by side rows in accordance with the several control functions which are to be sensed and directed to the actuating mechanisms of the embroidery machine. The control functions are sensed through the holes in the punching and mechanically establish the control function in the order in which they are read out of the punching. The punching or control tape indexes for each stitch thereby providing a continuous read-out of control information to the embroidery machine.

It is known, for example from U.S. Pat. No. 3,390,650 ('650), that an attachment may be useful for the application of sequins. Embroidery includes embellishment of cloth with sequins. Sequins are usually circular, shiny discs applied to garmets to increase the appeal and attractiveness of the garment. Sequins produced and applied by the prior art are subject to both deformation and flaking. In the deformed sequin, rather than the desired circular diameter, the sequin cut from the sequin strip has, for example, additional material at noon and material removed at six o'clock. See, for example, the "pit and mound" sequin shown in FIG. 7. This deformation is caused by imprecise contact of the two cutting edges between which edges each sequin is severed. Flaking can also occur when the strip is severed. Additionally in colored sequins, which are lacquered to provide sequins of various colors, this flaking is particularly noticeable. Sequins are embroidered onto cloth for decorative purposes, therefore flaking and deformation of sequins reduces the decorative value.

The '650 patent teaches a moveable cutter 70 which is brought, by the cutter-activating mechanism 82 on the needle rail, into alignment with the stationary cutter blade 66 to sever the leading sequin from a strip of sequins. The cutter 70 is substantially the width of the guide 64 which receives the sequins. Whenever the advancement of the sequin strip is not precise, this cutter 70 will sever a deformed sequin. The imprecise advancement has various causes, some of which are described below.

The '650 patent teaches a feed wheel 74 having sprockets 76 extending radially from the periphery thereof, another source of deformity of the sequins. These strockets typically wear and become thinner. The sequin strip, which is advanced via the strockets, is allowed more play both along the length of the strip and side-to-side within the guide 64, thereby allowing the sequins to be offset from the desired position for severing.

Each of the needle channels on the needle rail wear unevenly at a separate rate depending on the amount of use of each needle. Various embroidery patterns will utilize, for example, every other needle or every third needle thereby causing wear of only the needle channels of the utilized needles. This uneven wear affects the severing of the sequin, resulting in deformity and/or flaking, since the prior art does not allow for horizontal adjustment of each sequin attachment individually to compensate for the wear of the needle channel, but only for the adjustment of banks of sequin attachments. This results in some needles, corresponding to a sequin attachment, passing through the sequin at some location other than directly through the hole thereby damaging the sequin.

In the prior art the base plate, including the guide, is typically substantially heat treated steel. The end of the guide, which is the cutter blade, wears upon continual contact with the cutter, resulting in deformed and/or flaking sequins. A worn cutter blade requires replacement of the entire base plate.

The '650 patent provides for an upstanding base plate 60, of right angle constructon, which includes a vertically extending mounting section 62, which section 62 is provided with a vertically extending guide or chute 64 of a width to receive the strip of sequins. This guide 64 is an integral part of the base plate 60; the spacing between guides 64 cannot be altered without replacing the entire base plate 60. This lack of spacing alteration is an important limitation due to uneven wear of the needle channels.

Many portions of the feeding mechanism 56 including the clamp member 68, moveable cutter 70, and retaining string 80 are secured by rivets, bolts or the like to face plate 60. Replacing broken or worn parts also requires removing the entire base plate 60.

It is known to run conventional embroidery machines with sequin attachments at up to 100 revolutions per minute, which is 100 strokes or 50 stitches of a needle, where two strokes comprise a stitch. Any faster speed results in an unacceptable increase in embroidery errors, which material must either be discarded or repaired by hand, greatly increasing the cost of the overall operation.

SUMMARY OF THE INVENTION

The present invention enables a shuttle embroidery machine to apply sequins during embroidery of material such that sequins are substantially circular wihtout deformity, and which sequins do not flake during application. The feed member of a sequin attachment may be mounted, adjustably along a mounting bar, to correspond to each needle.

The strip of coin-shaped sequins is fed from a feed wheel via a rotary coin-feed wheel into the feed member. The rotary wheel is laminated with a bisected band containing a series of circular coin-shaped apertures. The strip is integrally fitted between the bisected band and restrained within the rotary wheel via a flexible spring extended concentrically over the rotary wheel. As the rotary wheel is precisely indexed via an electronic drive, the strip is advanced through the chute of the feed member.

The bottom of the chute of the feed member contains a cutter plate of sufficient hardness to resist substantial wear during repeated cutting operations. When a sequin is desired to be applied, the rotary wheel advances precisely to expose a single sequin from the bottom of the chute.

When the corresponding needle with a sleeve moves toward the cloth on the next stitch, the needle passes through the hole of the exposed sequin. When the sleeve makes contact with the sequin, the sleeve causes the sequin to sever at the scored neck portion where the sleeve contacts the cutter plate. The needle and sleeve carry the sequin to the cloth where it is embroidered onto the cloth.

When the control mechanism requires another sequin, the process starts anew with the indexing of the rotary wheel. During the stitches when no sequin is required to be applied, then there is no sequin exposed, and the needle merely embroiders per normal operation.

BRIEF DESCRIPTION OF THE DRAWINGS

FIG. 3 illustrates in part the strip lying in the rotary coin-feed wheel and in part the cross-section of the feed member.

FIG. 4 is a cross-section illustrating the cutter plate in the cutter recess.

FIG. 5 is a cross-section illustrating the platform and chute.

FIG. 6 illustrates a sequin produced by the present invention.

FIG. 7 illustrates a deformated sequin of the prior art.

DETAILED DESCRIPTION OF THE INVENTION

Figure 1:
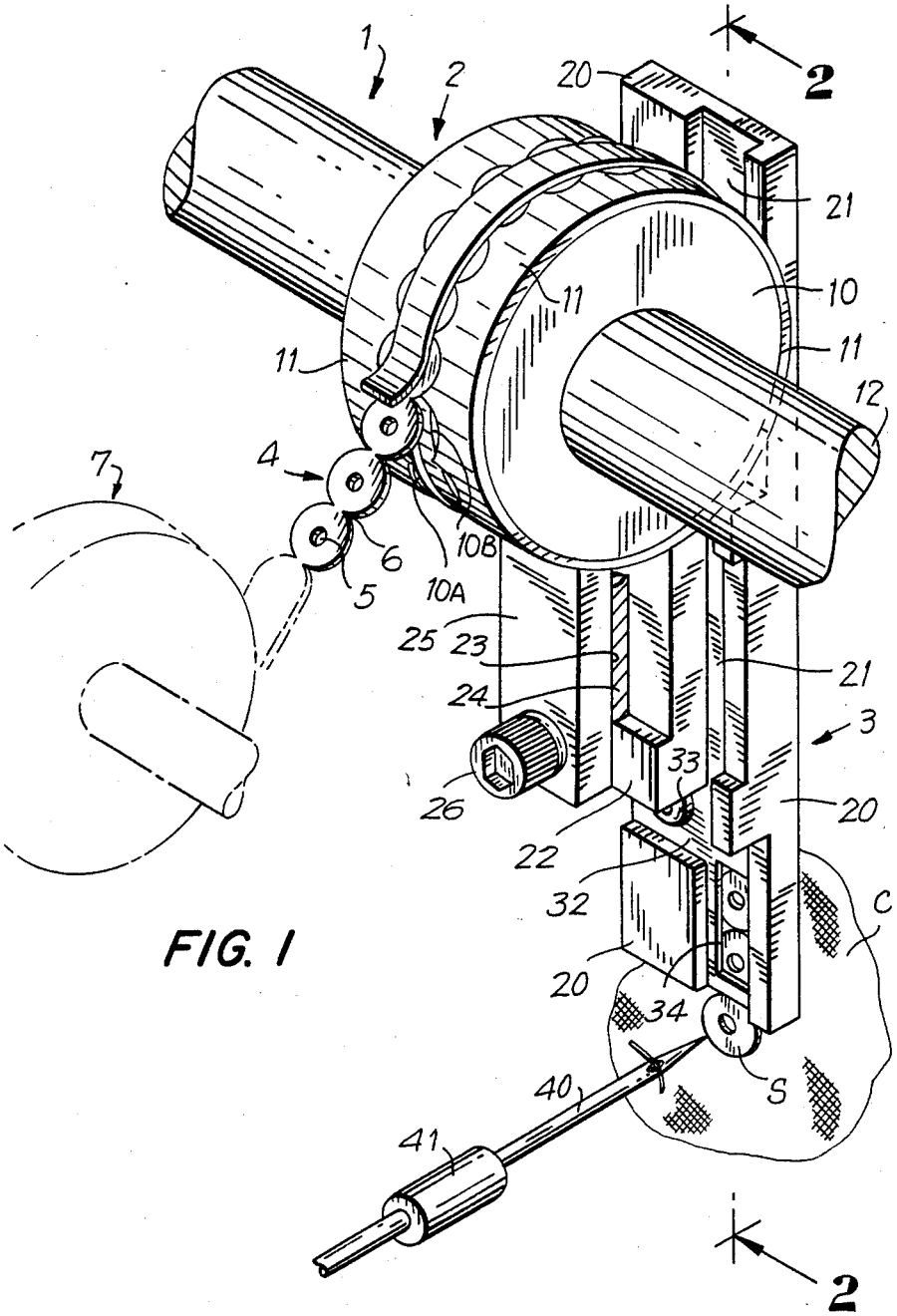
FIG. 1 illustrates a plurality of sequin attachments, for a shuttle embroidery machine, with rotary coin-feed wheel, feed member, and cylindrical sleeve.

An attachment 1 of the present invention as shown in FIG. 1, comprising rotary coin-feed wheel 2 and feed member 3, selectively severs and applies sequins S to cloth C incident to the embroidery thereof. An attachment 1 should be located corresponding each needle 40 as illustrated in FIG. 1. Strip 4 of coin-shaped sequins is fed from feed wheel 7 into feed member 3 via rotary wheel 2 wherein the strip 4 is severed at appropriate intervals to form a circular sequin S of FIG. 6 to be applied to the material during embroidery. The sequin S has a substantially circular outer diameter with a slight degree of flattening at noon and six o'clock due to the inherent process of severing the sequin S from the strip 4 without discarding any material. Hole 5, present also in strip 4, is centrally located in each sequin S and allows for passage of both needle 40 and thread.

Strip 4 of the present invention may be specially processed prior to use in attachment 1 of the present invention. At the neck portion 6 of strip 4, the strip 4 is scored, on one or both sides, perpendicular to length of the strip 4. Scoring of the strip 4 results in a cleaner separation of the sequin S from strip 4 thereby substantially reducing flaking. Careful scoring of strip 4 will ensure that the portion of strip 4 comprising the neck 6 is not unduly weak, and will not sever during feeding of strip 4 from feed wheel 7 to rotary wheel 2. Severing of strip 4 at this point disrupts the embroidery process and requires immediate rethreading of strip 4 into rotary wheel 2 and eventual manual mending of the embroidered cloth C. This strip 4 may also be scored on the other side of strip 4. The uniform undulating width of strip 4 must properly sized to fit closely within coin-feed band 11.

The scored strip 4 is fed from a feed wheel 7 on a support stand with rod (not shown), upon which rod the feed wheel 7 freely rotates. A corresponding feed wheel 7 is provided for each rotary wheel 2 along the length of the shuttle embroidery machine.

Figure 2:
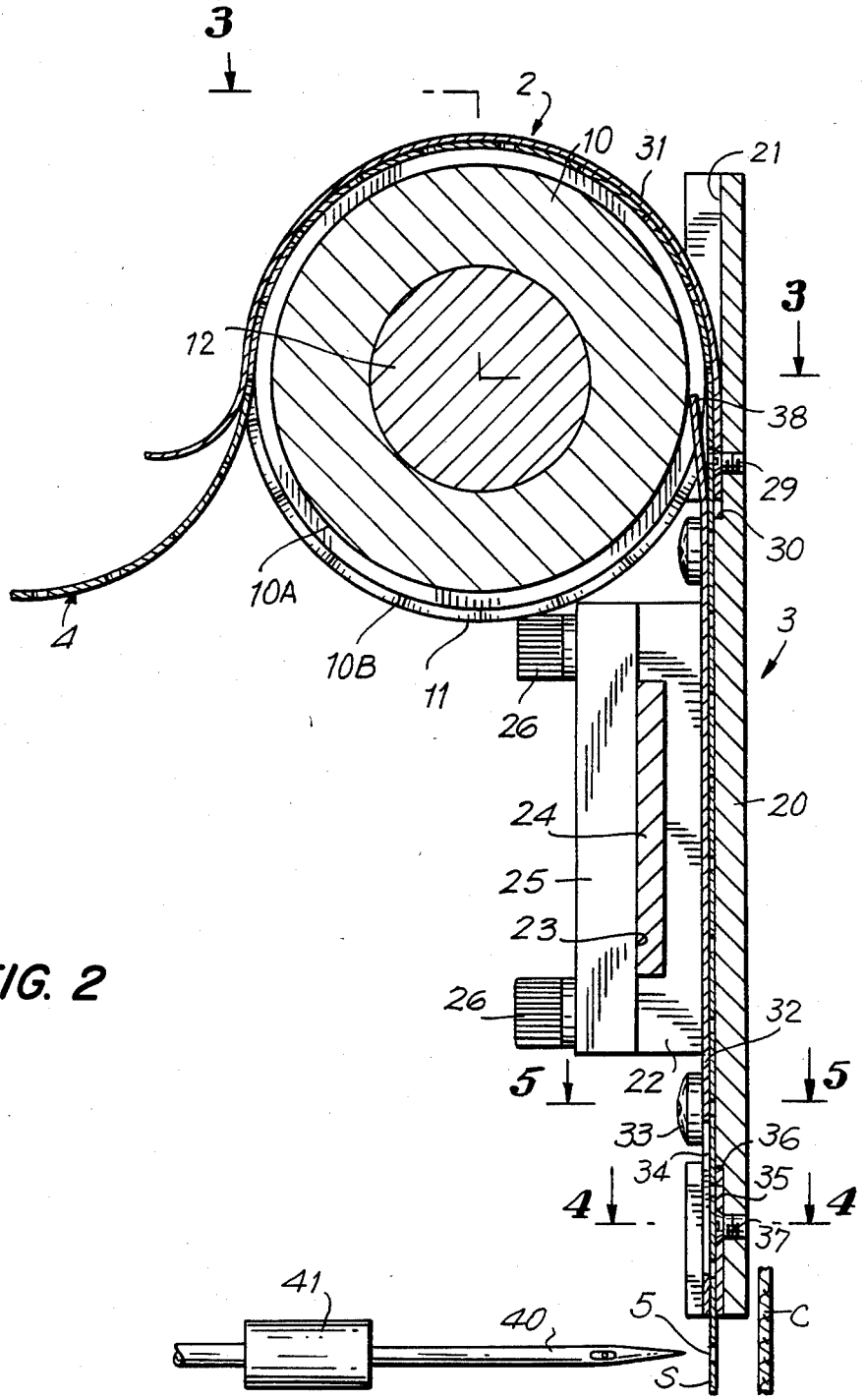
FIG. 2 is a cross-section view of the sequin attachment.

The scored strip 4 is fed from feed wheel 7 to rotary wheel 2. Rotary wheel 2, as shown in FIG. 2, comprises a core wheel 10 and coin-feed band 11. Core wheel 10 comprises aluminum. Core wheel 10 is incrementally indexed via feed shaft 12, which shaft 12 is inserted through and frictionally mounted within the axes of the plurality of rotary wheels 2. The groove 10A, located centrally along the circumferential perimeter of core wheel 10, accepts the tab 38 which ensures that strip 4 is properly fed into feed member 3. Groove 10A bisects the circumferential perimeter surface of core wheel 10 to form two radial surface edges 10B, which edges 10B are laminated with coin-feed band 11. Coin-feed band 11 is also bisected by groove 10A to form each half of coin-feed bank 11. Coin-feed bank 11 contains a series of intersecting circular apertures within which apertures strip 4 may be integrally fitted.

Strip 4 is fed into rotary wheel 2 lying upon and supported by edges 10B, being suspended over groove 10A and being inserted between the bisected coin-feed bands 11.

Each sequin-portion of strip 4 is integrally fitted into a circular coin-shpaed aperture of bands 11. As rotary wheel 2 is advanced a distance equivalent to the length of a sequin S via feed shaft 12, the coin-feed bands 11 evenly distributes the force to strip 4. The bands 11 comprise cold rolled steel or other material such that bands 11 can be laminated onto core wheel 10, can be previsely ground to snugly encompass sequin strip 4, and wil not be significantly worn over time. The present invention provides for more accurate advancement of the strip 4 than the sprocket arrangement of the prior art, thereby reducing deformity and flaking of the resulting sequins S.

Strip 4 is fed from rotary wheel 2, which is incrementally advanced or indexed via feed shaft 12, to feed member 3. Frame 20 of member 3 is aluminum or other material which may be easily and accurately ground. Frame 20 contains a vertical chute 21 wherethrough the strip 4 passes. Centrally located on frame 20 is platform 22, with duct 23 through which passes the mounting bar 24 (not shown), which bar 24 supports frame 20 on the shuttle embroidery machine. Both platform 22 and duct 23 are bisected by chute 21, and both support mounting bar 24 above chute 21.

Frame 20 is mounted by engaging mounting bar 24 into duct 23, and then securing cover bar 25 to platform 22 via fasteners 26. Fasteners 26 are preferably manual screws with heads projecting above the surface of cover bar 24 so that the position of frame 20 along the length of the embroidery machine can be easily and quickly manually adjusted via mounting bar 24 or removed for repair.

As illustrated in FIG. 3, at the top of chute 21, where strip 4 enters the chute 21, is a spring recess 30 wherein is fastened via spring screw 29, bolt or likemanner a spring 31. The width of spring 31 is less than the minimum distance between the bands 11. Spring 31 extends concentrically over rotary wheel 2 and is useful for applying pressure on strip 4 thereby maintaining strp 4 inserted between each half of coin-feed band 11, and lying on radial surface edges 10B and supported over groove 10A of rotary wheel 2. Spring 31 may be flexibly extended upward during threading of strip 4 into rotary wheel 2 and when released, spring 31 will again apply pressure on strip 4. Spring 31 is preferably fastened vai spring screw 29 so that any damaged spring 31 may be more readily replaced. The spring 31 comprises carbon spring steel. The spring 31 should be thin enough to retain its memory, but thick enough to resist breakage. Therefore, the thickness should be between 0.003 to 0.025 inch, and preferably between 0.007 to 0.009 inch, and most preferably be 0.008 inch.

Strip 4 is retained in chute 21 by plate 32. Plate 32 has a tab 38 extending upward and towards strip 4 in rotary wheel 2. The width of tab 38 is less than or equal to the width of groove 10A, and is placed into that groove 10A between the groove 10A and strip 4, for the purpose of guiding strip 4 into chute 21. Strip 4 passes into chute 21 between tab 38 and spring 31.

FIG. 5 illustrates that plate 32 is fastened, via for example two plate screws 33, bolts, or like manner, to frame 20 which frame 20 supports plate 32 over and to enclose the chute 21 along its length. Plate screws 33 are preferred to allow easy access to the chute, for example, to repair or replace the cutter plate 35 or spring 31.

As shown in FIG. 4, plate 32 also contains a window 34 at the bottom of chute 21 to afford a view of strip 4. The window 34 is a particularly important feature for reducing the amount of imperfect embroidered cloth C produced, which cloth C must be discarded or repaired by hand. The embroidery pattern may require that strip 4 be changed to a strip 4 of a different color or, occasionally, strip 4 will break between wheels 2 and 7. The strip 4 must be quickly rethreaded. If the strip 4 if merely placed into rotary wheel 2, a number of revolutions are required before the strip 4 works its way around rotary wheel 2 and through feed member 3 to produce a sequin S at cutter plate 35. The present inventions allows for the spring 31 to be lifted and the strip 4 inserted between spring 31 and tab 38, and into chute 21 during operation of the shuttle embroidery machine. The window 34 allows an immediate clear view of the location of strip 4 within chute 21 which reduces the quantity of damaged embroidered cloth C produced.

The cutter plate 35 is fastened into a cutter recess 36, preferably with a cutter screw 37 to allow repalcement or adjustment of cutter plate 35, recessed appropriately to obtain a continuous surface in chute 21 for passage of strip 4. Cutter plate 35 provides a durable cutting edge for severing the sequin S. The wearing of the cutting edge of the prior art frame results in deformed sequins as shown in FIG. 7. The cutter plate 35 of the present invention comprises blue tempered spring steel with a Rockwell harndess on the "C" scale of 54 to 60, and preferably 56 to 58. Most steels are unsuitable for the cutter plate 35 since the friction of repeated cutting operations will wear out the cutter edge.

When the controlling mechanism signals that a sequin S should be applied to cloth C, then rotary wheel 2 is actuated via feed shaft 12 causing the strip 4 to be indexed through chute 21 such that a single sequin S protrudes from the bottom of feed member 3. The strip 4 is indexed by an increment corresponding to the diameter of the successive sequins S such that neck 6 is brought into alignment with the cutting edge of cutter plate 35. A sequin S is not exposed from chute 21 until required, therefore during embroidery operation with no decorative application of sequins, sleeve 41 performs no function.

A cylindrical sleeve 41, with diameter approximately equal to the diameter of a single sequin S, is frictionally attached to its corresponding needle 40 via insertion of the needle 40 through the axis of the sleeve 41, and which sleeve 41 is positioned along the length of the needle 40 such that the sleever 41 will sever a single sequin S via contact with a cutting edge of cutter plate 35 of said feed member 3. When indexed to expose a sequin S, the needle 40 passes through the hole 5 in sequin S, and then through cloth C. The sequin S remains attached to strip 4 until sequin S contacts sleever 41. Sleeve 41 cleanly severs sequin S at scored neck portion 6 as sleeve 41 contacts cutter plate 35.

The sleeve 41 comprises a cylindrical member journaled upon the needle 40. The sleeve 41 must sufficiently hard to withstand repeated abrasion due to contact with cutter plate 35 during detachment of sequins S from strip 4. The sleeve 41 may comprise, for example, Delrin (E.I. Du Pont de Nemours and Co. trademark for polyoxymethylene).

The attachment 1 of the present invention greatly increases the accuracy of the sequin embroidery allowing the machine to run at up to 130 revolutions per minute.

While particular embodiments of the appartus and method have been illustrated and described, it will be readily apparent that many minor changes and modifications thereof could be made without departing from the spirit of the invention.

What is claimed is:

1. A shuttle embroidery machine with a plurality of needles and attachments for selectively applying sequin-like decoration to cloth, wherein an attachment corresponding to each needle of the machine comprises a rotary coin-feed wheel for indexing a strip of coin-shaped sequins through a feed member, wherein the decoration is cut from the strip, which rotary wheel is one of a plurality of rotary wheels which are incrementally indexed via a feed shaft inserted through and frictionally mounted within the axes of the plurality of rotary wheels, said feed member which positions and strip for severing of a single sequin wherein the feed member, mounted on the machine via a bar, is adjustably moveable along said bar, and a cylindrical sleeve, with diameter approximately equal to the diameter of a single sequin, which sleeve is frictionally attached to each corresponding needle via insertion of the needle through the axis of the sleeve and which sleeve is positioned along the length of the needle such that the sleeve will sever a single sequin via contact with a cutting edge of said feed member during movement of the needle to form an embroidery stitch.

2. The shuttle embroidery machine of claim 1 wherein the sleeve comprises polyoxymethylene.

3. The shuttle embroidery machine of claim 1 wherein the rotary coin-feed wheel comprises a core wheel which is laminated on its circumferential perimeter surface with a coin-feed band, wherein the core wheel surface is bisected by a groove forming two surface edges upon which edges a portion of the strip lies thereby suspending the strip over the groove and wherein the coin-feed band containing a series of intersecting circular coin-shaped apertures is bisected, by the groove of the core wheel, forming two halves such that the strip may be integrally fitted into the series of circular coin-shaped apertures formed between the halves of the band.

4. The shuttle embroidery machine of claim 3 wherein the band comprises cold rolled steel.

5. The shuttle embroidery machine of claim 3 wherein the core wheel comprises aluminum.

6. The shuttle embroidery machine of claim 3 wherein the feed member comprises a frame with a vertical chute wherein the strip is positioned by the chute for severing of a sequin as the strip passes from the top to the bottom of the chute, and wherein the chute is enclosed via a plate which plate is secured to the frame with plate screws, said plate having a tabbed member projecting from the plane of the plate into the groove of said rotary wheel between said groove and said strip thereby guiding the strip into the top of the chute, a restraining means for flexibly maintaining the strip in the rotary wheel, and a cutter plate at the bottom of the chute, comprising sufficiently hard composition such that repeated cutting of a sequin from the strip does not signficantly wear the cutter plate, and which plate is fixedly fastened within a cutter recess in the chute so as to obtain a continuous surface in the chute for passage of the strip.

7. The shuttle embroidery machine of claim 6 wherein the restraining means comprises a spring, fixedly fastened via a spring screw within a spring recess at the top of the chute so as to obtain a continuous surface in the chute for passage of the strip, the width of said spring being less than the minimum distance between the halves of the band, which spring extends concentrically over the rotary wheel and between the bands to flexibly maintain the strip between the halves of the band, and which spring can be flexed upwards for insertion of the strip into the rotary wheel.

8. The shuttle embroidery machine of claim 7 wherein the thickness of the spring is sufficiently thin to retain memory and sufficiently thick to resist breakage.

9. The shuttle embroidery machine of claim 8 wherein the thickness of the spring is about 0.003 to 0.025 inch.

10. The shuttle embroidery machine of claim 8 wherein the thickness of the spring is 0.007 to 0.009 inch.

11. The shuttle embroidery machine of claim 8 wherein the thickness of the spring is 0.008 inch.

12. The shuttle embroidery machine of claim 8 wherein the cutter plate comprises of blue tempered spring steel.

13. The shuttle embroidery machine of claim 12 wherein the cutter plate has a Rockwell hardness on the "C" scale in the range of 54 to 60.

14. The shuttle embroidery machine of claim 12 wherein the cutter plate has a Rockwell hardness on the "C" scale in the range of 56 to 58.

15. The shuttle embroidery machine of claim 6 wherein the plate contains a window, located at the bottom of the chute, which exposes the strip to view such that the strip may be positioned for severing.

16. The shuttle embroidery machine of claim 1 wherein the strip of coin-shaped sequins is scored, perpendicular to the length of the strip, at each neck portion of the strip where each sequin is to be severed from the strip.

17. A shuttle embroidery machine with a plurality of needles and attachments for selectively applying sequin-like decoration to cloth, wherein an attachment corresponding to each needle of the machine comprises a rotary coin-feed wheel for indexing a strip of coin-shaped sequins through a feed member, wherein the decoration is cut from the strip, which rotary wheel is one of a plurality of rotary wheels which are incrementally indexed via a feed shaft inserted through and frictionally mounted within the axes of the plurality of rotary wheels, which rotary wheel comprises a core wheel which is laminated on its circumferential perimeter surface with a coin-feed band wherein the core wheel surface is bisected by a groove forming two surface edges upon which edges a portion of the strip lies thereby suspending the strip over the groove and wherein the coin-feed band containing a series of intersecting circular coin-shaped apertures is bisected, by the grooves of the core wheel, forming two halves such that the strip may be integrally fitted into the series of circular coin-shaped apertures formed between the halves of the band, said feed member which positions said strip for severing of a single sequin wherein the feed member, mounted on the machine via a bar, is adjustably moveable along said bar, and wherein the feed member comprises a frame with a vertical chute wherein the strip is positioned by the chute for severing of a sequin as the strip passes from the top to the bottom of the chute, and wherein the chute is enclosed via a plate which plate is secured to the frame with plate screws, said plate having a tubbed member projecting from the plane of the plate into the groove of said rotary wheel between said groove and said strip thereby guiding the strip into the top of the chute, a restraining means for flexibly maintaining the strip in the rotary wheel, and a cutter plate at the bottom of the chute, comprising sufficiently hard composition such that repeated cutting of a sequin from the strip does not significantly wear the cutter plate, and which plate is fixedly fastened within a cutter recess in the chute so as to obtain a continuous surface in the chute for passage of the strip, and a cylindrical sleeve, with diameter approximately equal to the diameter of a single sequin, which sleeve is frictionally attached to each corresponding needle via insertion of the needle through the axis of the sleeve and which sleeve is positioned along the length of the needle such that the sleeve will sever a single sequin via contact with the cutting edge of said feed member during movement of the needle to form an embroidery stitch.

18. The shuttle embroidery machine of claim 17 wherein the restraining means comprises a spring, fixedly fastened via a spring screw within a spring recess at the top of the chute so as to obtain a continuous surface in the chute for passage of the strip, the width of said spring being less than the minimum distance between the halves of the band, which spring extends concentrically over the rotary wheel and between the bands to flexibly maintain the strip between the halves of the band, and which spring can be flexed upwards for insertion of the strip into the rotary wheel.

19. The shuttle embroidery machine of claim 18 wherein the plate contains a window, located at the bottom of the chute, which exposes the strip to view such that the strip may be positioned for severing.

20. A method of selectively applying sequin-like decoration to cloth via a shuttle embroidery machien including a controlling mechanism and a plurality of needles and attachments, wherein each attachment comprises a rotary coin-feed wheel, a feed member, and a cylindrical sleeve, which method comprises upon a signal froom the controlling mechanism, incrementally indexing via a feed shaft, which shaft is inserted through and frictionally mounted within the axes of the plurality of rotary wheels, a strip of coin-shaped sequins through the rotary coin-feed wheel, positioning said strip, indexed from the rotary wheel, for severing of a single sequin from the strip via the feed member, whereby a single sequin is exposed from the bottom of a chute in said feed member, severing a single sequin from the strip via contact of a cylindrical sleeve, which sleeve is frictionally attached to each corresponding needle via insertion of the needle through the axis of the sleeve, with a cutter plate of said feed member during movement of the needle to form an embroidery stitch wherein the needle passes through a central hole in said sequin, and embroidering said sequin onto said cloth via said needle.

21. A method of selectively applying sequin-like decoration to cloth, via a shuttle embroidery machine including a controlling mechanism and a plurality of needles and attachments, wherein each attachment comprises a rotary coin-feed wheel, a feed member, and a cylindrical sleeve, which method comprises upon a signal from the controlling mechanism, incrementally indexing via a feed shaft, which shaft is inserted through and frictionally mounted within the axes of the plurality of rotary wheels, which rotary wheel comprises a core wheel laminated with a coin-feed band, wherein a groove bisects the circumferential perimeter surface of the core wheel forming two surface edges and bisects the series of intersecting circular coin-shaped apertures of the band forming two halves, a strip of coin-shaped sequins, lying upon the two surface edges of the core wheel and integrally fitted into the series of apertures of the band, through the rotary coin-wheel, while flexibly maintaining the strip in the rotary wheel via a spring, and positioning said strip, indexed from the rotary wheel, for severing of a single sequin from the strip via the feed member wherein the strip passes through a vertical chute in the frame of the feed member, thereby exposing a single sequin from the bottom of said chute, guiding the strip into the top of the chute via a tabbed member projecting from the plane of a plate, which plate forms a side of the chute, and severing a single sequin from the strip, via contact of a cylindrical sleeve, which sleeve is frictionally attached to each corresponding needle via insertion of the needle through the axis of the sleeve, with a cutting edge of a cutter plate at the bottom of the chute of said feed member, said cutter plate comprising sufficiently hard composition such that repeated cutting does not significantly wear the cutter plate during movement of the needle to form an embroidery stitch wherein the needle passes through a central hole in said sequin, and embroidering said sequin onto said cloth via said needle.

* * * * *